US005992683A

United States Patent [19]

Sigl

[11] Patent Number: 5,992,683

[45] Date of Patent: Nov. 30, 1999

[54] CLIP LIFT FOR SHEET DISPENSING SYSTEM

[75] Inventor: Wayne C. Sigl, Neenah, Wis.

[73] Assignee: Kimberly-Clark Worldwide, Inc., Neenah, Wis.

[21] Appl. No.: 09/144,592

[22] Filed: Aug. 31, 1998

[51] Int. Cl.[6] ..... B65H 1/08

[52] U.S. Cl. ..... 221/59; 221/52; 221/56

[58] Field of Search ..... 221/45, 52, 56, 221/59

[56] References Cited

U.S. PATENT DOCUMENTS

| | | | |
|---|---|---|---|
| 1,209,054 | 12/1916 | Skall . | |
| 1,593,532 | 7/1926 | Hansen . | |
| 2,011,403 | 8/1935 | Gessler . | |
| 2,287,420 | 6/1942 | Edmonston . | |
| 2,501,357 | 3/1950 | Speckman et al. . | |
| 2,634,855 | 4/1953 | Mandel . | |
| 2,636,599 | 4/1953 | Willis et al. . | |
| 2,713,454 | 7/1955 | Nute et al. . | |
| 2,802,567 | 8/1957 | Covel . | |
| 2,816,699 | 12/1957 | Nute et al. . | |
| 2,849,152 | 8/1958 | Tuttle . | |
| 2,854,184 | 8/1958 | Heine . | |
| 2,858,045 | 10/1958 | Loeb . | |
| 3,202,316 | 8/1965 | Silver | 221/52 |
| 3,224,633 | 12/1965 | Allen . | |
| 3,313,583 | 4/1967 | Turkington et al. . | |
| 3,425,595 | 2/1969 | Shapira . | |
| 3,459,329 | 8/1969 | Mochizuki et al. . | |
| 3,603,452 | 9/1971 | Singer . | |
| 3,606,082 | 9/1971 | Kuchenbecker . | |
| 3,647,114 | 3/1972 | Bleuer | 221/59 |
| 3,942,682 | 3/1976 | McKay . | |
| 4,231,491 | 11/1980 | Pierson et al. . | |
| 4,586,631 | 5/1986 | Loder . | |
| 4,616,767 | 10/1986 | Seido . | |
| 4,816,094 | 3/1989 | Pomplun et al. | 156/85 |
| 5,363,985 | 11/1994 | Cornell . | |

FOREIGN PATENT DOCUMENTS

| | | |
|---|---|---|
| 111782 | 3/1981 | Germany . |

*Primary Examiner*—William E. Terrell
*Assistant Examiner*—Gene O. Crawford
*Attorney, Agent, or Firm*—Brinks Hofer Gilson & Lione

[57] ABSTRACT

This invention relates to a sheet dispensing system which includes a clip lift member. The clip lift member of the present invention is positioned beneath the stack of sheets placed in the carton. The clip lift is comprised of an elastic member which is placed underneath a stack of sheets and is connected to the end walls of the carton. The clip lift may include a support member positioned between the sheets and the elastic member which may support the weight of the tissues. The clip lift biases the sheets in an upward direction as the sheets are being dispensed. The elastic member may be comprised of any elastic member, including a heat-activatable elastic member, which may be microwave susceptible.

26 Claims, 5 Drawing Sheets

FIG. 6
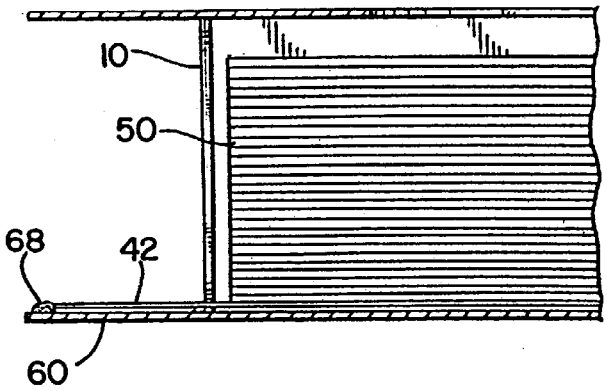
FIG. 7
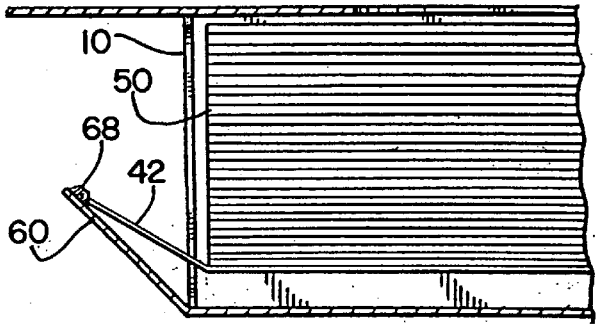
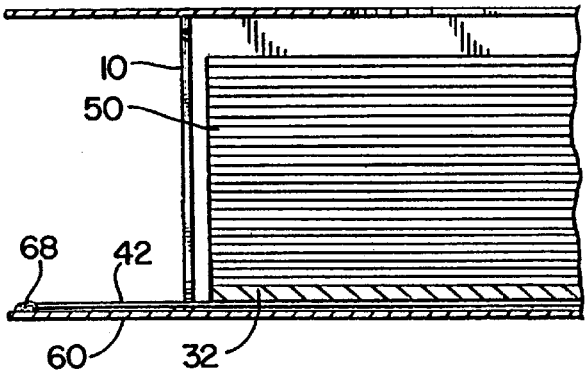
FIG. 8
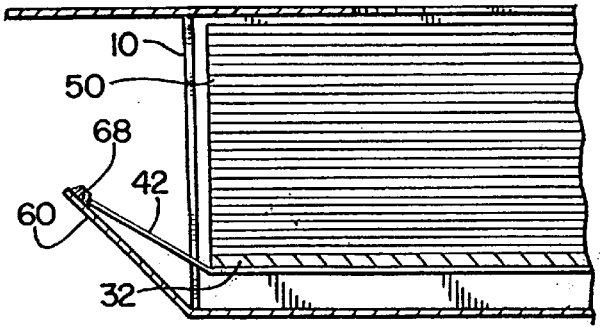
FIG. 9

CLIP LIFT FOR SHEET DISPENSING SYSTEM

BACKGROUND OF THE INVENTION

This invention relates to a sheet dispensing system, and more particularly, to a clip lift for such a system which lifts the sheets up towards the opening through which the sheets are dispensed as the sheets are being dispensed.

Sheets such as facial tissues, paper towels, industrial towels and the like are well known in the art. The uses of sheets include, but are not limited to, blowing one's nose, cleaning one's glasses and other cleaning uses. Generally, a sheet dispensing system includes a stack of sheets placed within a carton. A stack of sheets ready to be put into a carton is known in the field as a clip. There are two basic types of cartons: the pop-up variety and the reach-in variety.

A pop-up carton is generally a square or rectangular carton with a sheet dispensing opening on its top wall. The sheets are generally interfolded with each other in pop-up cartons, which is well known in the art. Interfolding means that each sheet is folded around part of the sheet immediately beneath the first sheet. There are various types of interfolding, such as Z-folding or V-folding. Because of the interfolding of the sheets, when a first sheet is pulled up through the dispensing opening, a leading section of a second sheet, i.e., the sheet immediately beneath the first sheet, is also pulled part way through the opening.

In addition, a pop-up carton may include a piece of clear plastic film which covers the sheet dispensing opening. The film is slit such that sheets are dispensed from the carton through the slit. Because the slit is small, sheets are constricted from falling back through the slit once they have been pulled part way through the slit. If there is no such film covering the dispensing opening, generally then at one point of the opening, the opening is narrow enough to constrict the sheets.

Thus, as a result of interfolding the sheets and constricting the sheets by the slit, sheets are dispensed from a pop-up carton in the following manner. For the first sheet, the user must reach through the slit to grab the sheet to begin the sheet dispensing process. As the first sheet is being dispensed, because the sheets are interfolded, the leading section of the second sheet is pulled through the slit. Again, because of the slit, the leading section of the second sheet is constricted and will preferably not fall back through the slit into the carton. The leading section of the second sheet preferably remains outside of the carton, while the trailing section of the second sheet remains inside of the carton, interfolded with a third sheet. Then, when the second sheet is dispensed from, i.e., pulled out of, the carton, the leading section of a third sheet is pulled part way through the opening and is then constricted by the slit from falling back into the carton. Thus, the leading section of the third sheet remains outside of the carton for the next use. This process continues until all sheets have been dispensed from the carton.

A reach-in carton is also basically a square or rectangular carton which has a sheet dispensing opening on its top wall which extends down to include a large part of a side wall of the carton. For a reach-in carton, the sheets are generally not interfolded. To dispense sheets, the opening on the side wall of the carton is large enough such that a person simply reaches into the carton to pull out one or more sheets.

There are fall back problems associated with pop-up cartons. For instance, a sheet may not be interfolded with the sheet below it, i.e., there may be missed interfolds between two successive sheets. If this occurs, when the first sheet is dispensed, the second sheet will not rise up with the first sheet through the sheet dispensing slit in the film. Thus, there will be no sheet for a person to grab from above the carton. When this occurs, the person has to reach through the slit of the film covering the sheet dispensing opening and grab the second sheet and basically restart the pop-up sheet process. The film, however, may be distorted and stretched when a person reaches through it to grab a sheet from inside the carton. A distorted and stretched film may result in more fall backs of sheets.

Fall back of sheets may be more prevalent in a deeper carton where there is more distance between the sheet and the top wall dispensing opening or slit. The second sheet may separate from the first sheet as the space between the top of the sheet stack and the top wall dispensing slit progressively increases as the height of the sheet stack decreases. Thus, the second sheet may at first rise up with the first sheet but may then separate from the first sheet before it is pulled through the sheet dispensing slit. Again, then, a user would have to reach through the sheet dispensing slit, distorting and stretching the film covering the sheet dispensing opening, to restart the pop-up sheet process.

In the past, efforts have been made to provide a member in a carton to bias sheets toward the dispensing opening. For instance, U.S. Pat. No. 3,202,316, issued to Silver, is directed to a biased stack tissue dispenser, which includes an elastic strip, which has its ends connected to the side walls of the carton, and a cradle. The cradle is positioned below the stack of tissues and above the elastic strip. In addition, U.S. Pat. No. 3,647,114, issued to Bleuer, is directed to a tissue dispenser, which includes a band of elastic material which is connected to the side panels of the carton. The elastic material is held inactive until released by the user by punching out a perforation line in the bottom wall of the carton. Last, U.S. Pat. No. 4,616,767, issued to Seido, is directed to a tissue paper box, which includes an elastic strip connected to one wall of the box. The elastic strip is partly removable through the dispensing outlet and may be wrapped around the box to maintain the box in a compact form after all of the tissues have been removed from the box. These dispensers, however, are subject to the disadvantage of difficulty in their manufacture due to the fact that the elastic strip is connected to the side walls of the carton. In addition, these dispensers are subject to the disadvantage of difficulty in the insertion of tissues or sheets in the carton. In particular, if the elastic is connected to the side walls, then the tissues are inserted perpendicular to the elastic strip into the carton, which may result in tearing of the tissues.

Accordingly, it would be desirable to provide a sheet dispensing system with a clip lift feature that eliminates or decreases the fall back problems associated with pop-up cartons which is easy and convenient to manufacture. Moreover, it would be desirable to provide a sheet dispensing system which includes a clip lift feature where it is easy to slide sheets into the carton of the system without tearing the sheets.

SUMMARY OF THE INVENTION

The present invention is directed to a sheet dispensing system, and more particularly, to a sheet carton which includes a clip lift for moving the sheets in a vertical direction as the sheets are dispensed from the carton. With the present invention, sheets are always presented right at the sheet dispensing opening of the carton.

One aspect of the invention provides a sheet dispensing system including a clip lift member. The system includes a carton, which has a top wall, a bottom wall, two end walls and two side walls. A stack of interfolded sheets is disposed within the carton. The top wall of the carton has an opening, through which sheets are dispensed. The clip lift member is positioned beneath the stack of interfolded sheets and above the bottom wall of the carton. In one embodiment, the clip lift member is comprised of an elastic member. One end of the elastic member is connected to one end wall of the carton, while the second end of the elastic member is connected to the opposite end wall of the carton. As sheets are dispensed from the carton and the weight and/or bulk of the sheets holding the elastic member in a stretched position diminishes, the elastic member relaxes in tension, that is, the elastic member contracts in length. As the elastic member contracts in length between its two ends, the central portion of the elastic member moves upward toward the top wall, thereby biasing the stack of interfolded sheets in an upward direction toward the sheet dispensing opening in the top wall.

Another aspect of the invention provides a sheet dispensing system including a clip lift member. The system includes a carton, which has a top wall, a bottom wall, two end walls and two side walls. A stack of interfolded sheets is disposed within the carton. The top wall of the carton has an opening, through which sheets may be dispensed. The clip lift member is positioned beneath the stack of interfolded sheets and above the bottom wall of the carton. In this embodiment, the clip lift member is comprised of a support member and an elastic member. The support member is positioned beneath the stack of interfolded sheets and above the bottom wall of the carton. The elastic member is positioned beneath the support member. One end of the elastic member is connected to one end wall of the carton, while the second end of the elastic member is connected to the opposite end wall of the carton. As sheets are dispensed from the carton and the weight and/or bulk of the sheets holding the elastic member in a stretched position diminishes, the elastic member relaxes in tension so that it contracts in length. As the elastic member contracts in length between its two ends, the central portion of the elastic member moves upward toward the top wall, thereby biasing the support member to move upward, which in turn causes the stack of interfolded sheets to move in an upward direction toward the sheet dispensing opening in the top wall.

Another aspect of the invention provides a method of manufacturing a sheet dispensing system with a clip lift member. One step is to provide a carton, which has a top, a bottom, two end and two side walls. The end wall has at least one flap. An elastic member is inserted into the carton, and one end of the elastic member is connected to one end wall of the carton and the second end of the elastic member is connected to the opposite end wall. Sheets are then inserted into the carton on top of the elastic member. The flaps of the end walls are then closed. In one embodiment, closing the flaps causes the elastic member to be stretched.

The elastic member may be a plurality of elastic members. The elastic member may be a rubber band. Preferably, the elastic member is a heat-activatable elastic (HAE) material which recovers its elastic properties after being heated. More preferably, the heat-activatable elastic material is heated by microwaves to recover its elastic properties. Preferably, the support member is a cardboard material.

These and other objects, advantages, and features of the present invention will be better understood upon review of the following detailed description of the preferred embodiments.

BRIEF DESCRIPTION OF THE DRAWINGS

FIG. 6 is a cross-sectional view of a flap of an end wall of the sheet dispensing system of FIG. 2 before the end wall is adhered closed;

FIG. 7 is a cross-sectional view of the flap of FIG. 6 as the flap of the end wall is about to be adhered closed;

FIG. 8 is a cross-sectional view of a flap of an end wall of a sheet dispensing system incorporating another embodiment of the clip lift of the present invention before the end wall is adhered closed;

FIG. 9 is a cross-sectional view of the flap of FIG. 8 as the flap of the end wall is about to be adhered closed;

DETAILED DESCRIPTION OF THE PREFERRED EMBODIMENTS

Figure 1:
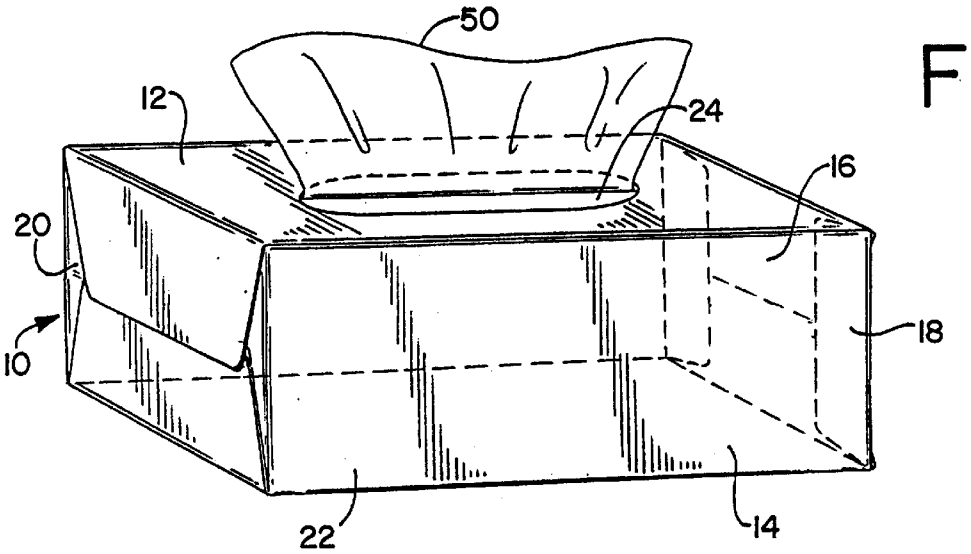
FIG. 1 is a perspective view of a sheet dispensing system.

FIG. 1 illustrates a perspective view of the sheet dispensing system. Generally, the sheet dispensing system includes a generally square or rectangular carton 10, which has a top wall 12, two side walls 14, 16, two end walls 18, 20 and a bottom wall 22. The top wall 12 is provided with an opening 24. The opening 24 may also be located in the top wall 12 and a side wall 14 or in the top wall 12 and one or more side walls. The opening 24 may be covered by a plastic film covering (not shown), which has a slit formed therein (also not shown), wherein sheets 50 are dispensed in a pop-up manner through the slit. The opening 24 or the slit is small enough such that sheets 50 will be constricted from falling back through the opening 24 or slit after they have been pulled through the opening 24 or slit.

A plurality of sheets are stacked inside the carton 10. Preferably, the sheets are interfolded. There are a variety of ways of interfolding sheets, such as a Z-fold or a V-fold, which are well known in the art. Pop-up dispensing of the sheets is possible due to the interfolding of sheets and the constriction on the sheets caused by the opening 24. In particular, due to interfolding of the sheets, when a first sheet is pulled up through the opening, a leading section of the sheet immediately beneath the first sheet, i.e., a second sheet, is pulled through the opening. Because of the constriction on the sheets tissue dispensing by the opening, once the leading section of the second sheet is outside the carton, this sheet will preferably not fall back through the opening. Thus, the leading section of the second sheet will remain outside of the carton, while the trailing section of the second sheet will remain inside of the carton, interfolded with a third sheet.

The above process is repeated when a person pulls the second sheet out of the carton. Because a third sheet is interfolded with the second sheet, a leading section of the third sheet will be pulled through the tissue dispensing opening. Due to the constriction on the leading section of the third sheet by the tissue dispensing opening, this sheet will preferably not fall back through the opening but will instead remain outside of the carton for the next use. This process may be repeated again and again until all of the sheets have been dispensed from the carton As shown in FIGS. 2 through 13, the elastic member 42 is connected to both end walls 18, 20 of the carton 10. During the carton manufacturing process, one or more pieces of elastic member 42 are inserted through the bottom of the carton 10 to be connected to the inside of both of the end walls 18, 20. The elastic member 42 may be connected to the end walls 18, 20 so that the elastic member 42 is releasably connected to the end walls 18, 20. In the alternative, the elastic member 42 may be connected to the end walls 18, 20 so that the elastic member 42 is permanently attached to the end walls 18, 20.

Figure 2:
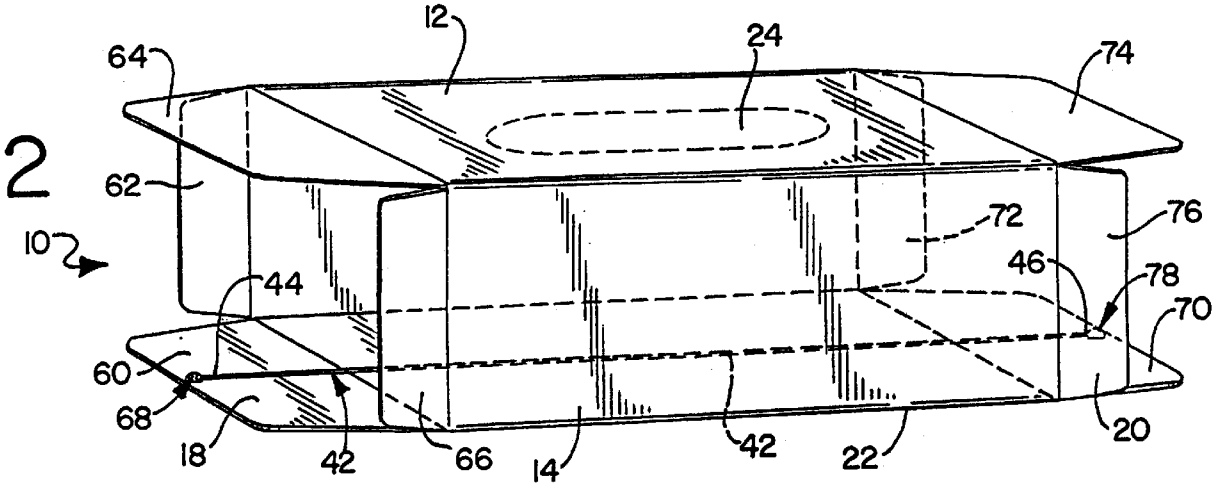
FIG. 2 is a perspective view of a sheet dispensing system incorporating one embodiment of the clip lift of the present invention when no sheets are present in the system.

More particularly, as shown in FIG. 2, each end wall 18, 20 is made of at least one flap. Preferably, the end wall 18 is made of four flaps 60, 62, 64, 66. Similarly, end wall 20 is preferably made of four flaps 70, 72, 74,76. As shown in FIG. 2, during the manufacture of the carton 10, a spot of adhesive 68 is applied to one end flap 60 of end wall 18, and another spot of adhesive 78 is applied to one end flap 70 of end wall 20. After the elastic member is brought through the carton 10, near the bottom of the carton 10, end 44 of the elastic member 42 is connected to the end flap 60 at the point of adhesive 68 and end 46 of the elastic member 42 is connected to end flap 70 at the point of adhesive 78. The elastic member 42 is in a stretched position when connected to end walls 18, 20 or is a heat-activatable (HAE) material, which is generally not stretched when connected to end walls 18, 20.

Figure 3:
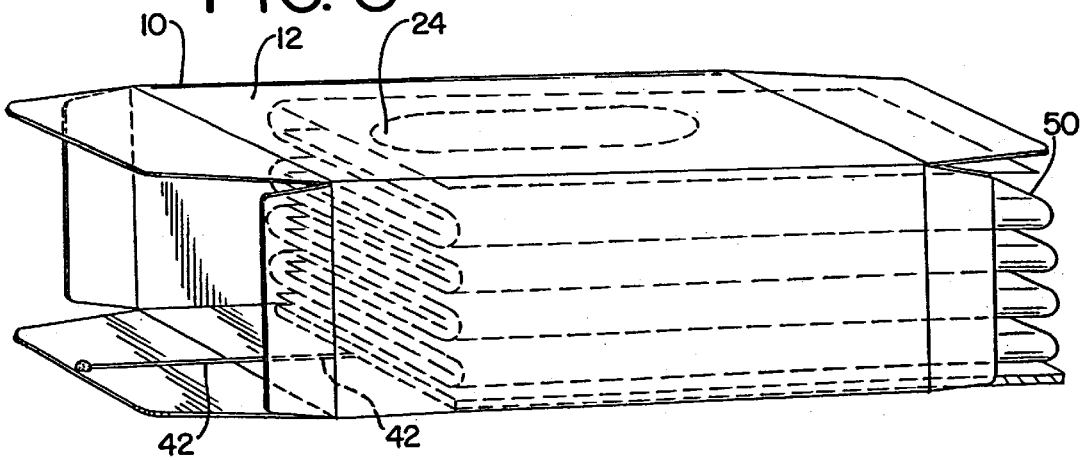
FIG. 3 is a perspective view of the insertion of a stack of sheets into the sheet dispensing system shown in FIG. 2.
Figure 4:
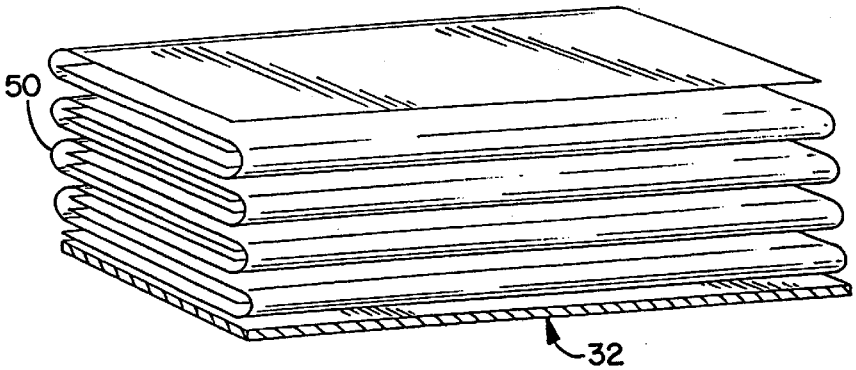
FIG. 4 is a perspective view of a stack of sheets placed onto a support member.
Figure 5:
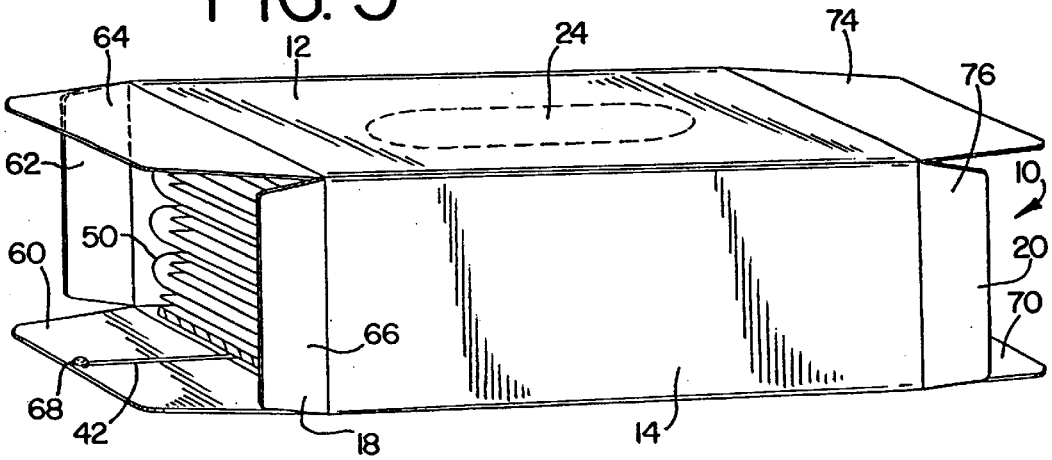
FIG. 5 is a perspective view of the sheet dispensing system of FIG. 2 when a full stack of sheets is present in the system.

Next, as shown in FIG. 3, a stack of facial sheets 50 is inserted into the carton 10, on top of the elastic member 42. In one embodiment, as shown in FIG. 4, the stack 50 is first placed on a support member 32 before being placed into the carton 10, on top of the elastic member 42. The carton 10 as loaded with the sheets 50 on the elastic member 42 is illustrated in FIG. 5.

As shown in FIGS. 6 and 7, the end flaps of the end walls 18, 20 are then adhered together to form a rectangular carton 10. FIG. 6 shows the end flap 60 before it is adhered to the other end flaps 62, 64, 66 of end wall 18 to close end wall 18. FIG. 7 shows the end flap 60 as it is being brought into contact with the other flaps to close end wall 18. Similarly, flap 70 is brought into contact with the other flaps 72, 74, 76 of end wall 20 to close end wall 20 (not shown). FIGS. 8 and 9 show the end flaps of the end walls being adhered together when the support member 32 is positioned beneath the sheets 50.

In one embodiment, the elastic member 42 is connected to the end walls 18, 20 while it is stretched and is thus under tension. Therefore, the elastic member 42 is already in a stretched position when the end flaps are brought together to close the end walls 18, 20. When the end walls 18, 20 are closed, the direction of the stretch of the elastic member 42 changes. The minimum amount of stretch that the elastic member 42 must be stretched is the difference between (1) the distance between the two spots of adhesive 68, 78 and (2) the length of the bottom wall 14. Preferably, the elastic member 42 is stretched even more than the minimum amount of stretch.

In a preferred embodiment, the elastic member is not in a stretched position when it is connected to the end walls 18, 20. In this embodiment, the elastic member is a HAE material. HAE materials are well known in the art. For example, HAE has been used to facilitate elastic waistbands in diapers. One example of a HAE is described in U.S. Pat. No. 4,816,094, issued to Pomplun et al., herein incorporated by reference. Upon application of heat, the HAE material recovers its elastic properties.

The HAE member 42 is connected to the carton 10 as described above. However, as stated above, because the HAE member 42 is heat-activatable, the HAE member 42 does not have be stretched when inserted into the carton 10. At some point after the end walls 18, 20 are adhered together, the carton 10 is heated to activate the HAE member 42. After the HAB member 42 is heated, it recovers its elastic properties.

Figure 10:
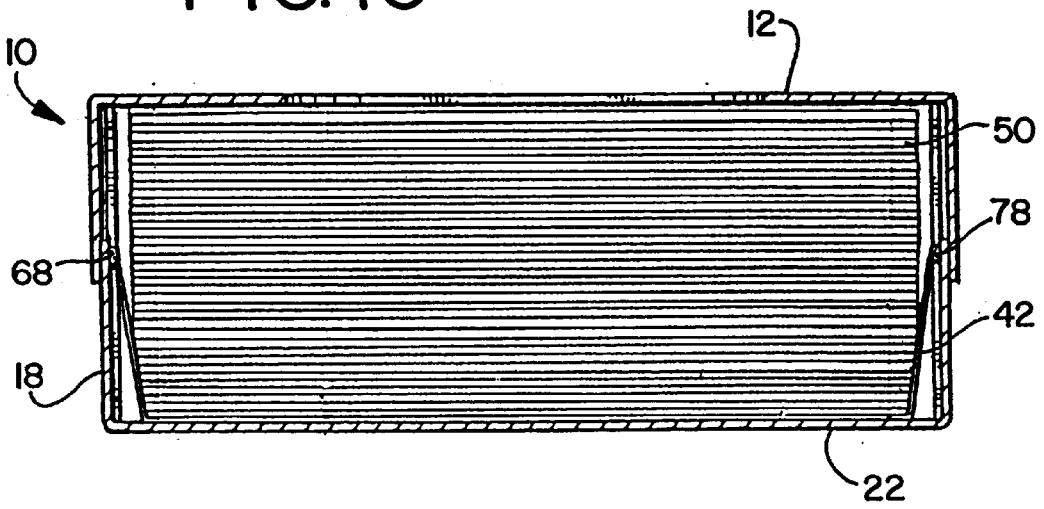
FIG. 10 is a cross-sectional view of the sheet dispensing system of FIG. 7 when the clip lift is in a flat position.
Figure 11:
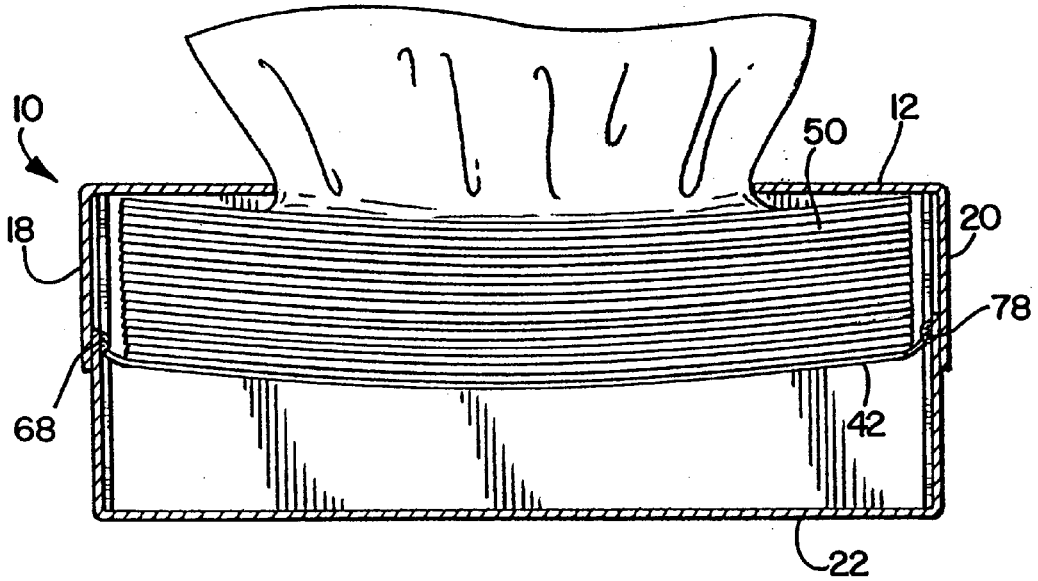
FIG. 11 is a cross-sectional view of the sheet dispensing system of FIG. 10 after the clip lift has moved in an upward direction.
Figure 12:
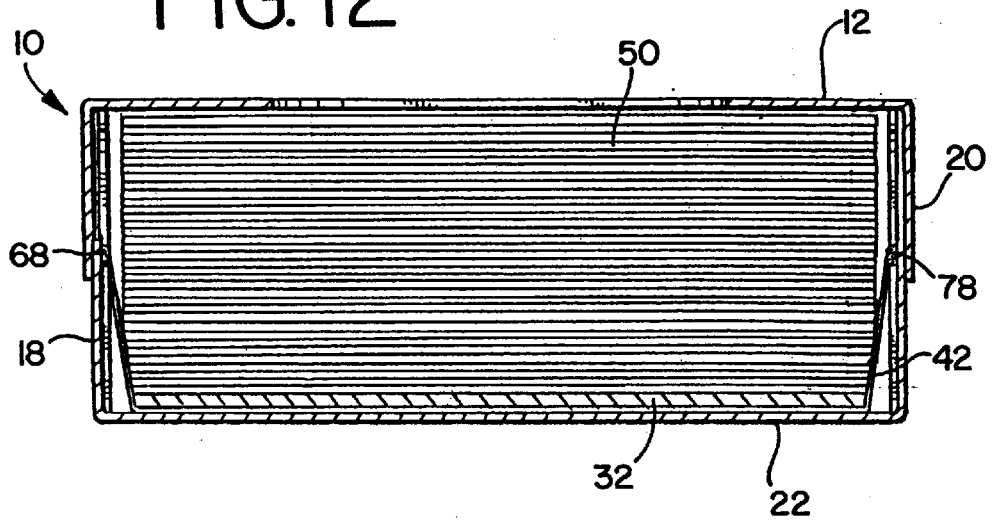
FIG. 12 is a cross-sectional view of the sheet dispensing system of FIG. 9 when the clip lift is in a flat position.
Figure 13:
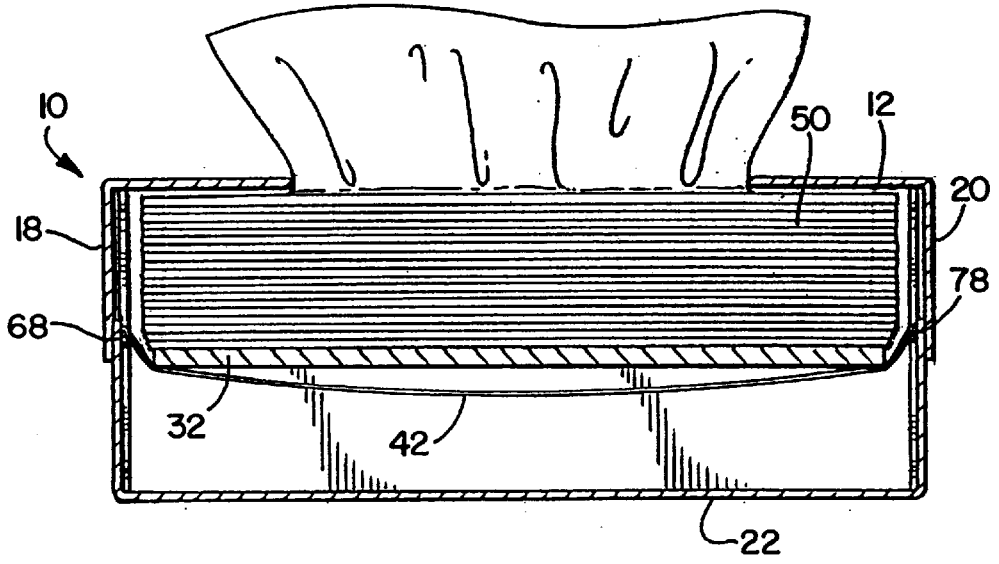
FIG. 13 is a cross-sectional view of the sheet dispensing system of FIG. 12 after the clip lift has moved in an upward direction.

The clip lift of this embodiment then performs in the following manner. In the beginning, as shown in FIG. 10 (or FIG. 12 if a support member 32 is utilized), when the carton 10 is full with sheets 50, the weight of the sheets 50 on the elastic member 42 holds the elastic member 42 in a flat position. The elastic member 42 must be in a stretched position at this point—either by being connected in a stretched position or, if the elastic member 42 is an HAE material, by being heated. Once sheets 50 are dispensed from the carton 10 and the weight of the sheets 50 on the elastic member 42 diminishes, the elastic member 42 begins to relax, or to experience a decrease in tension from its stretched position. Because of its elastic properties, the equilibrium of the elastic member 42 is in a straight line from its two ends 44, 46, which are connected to the two end walls 18, 20 of the carton 10. Thus, as the weight on the elastic member 42 decreases, the length of the elastic member 42 begins to decrease or, in other words, the elastic member 42 begins to contract between its two ends 44, 46. As shown in FIG. 11 (or FIG. 13 if a support member 32 is utilized), this action biases the sheets 50 toward the top wall 12 of the carton 10. This results in a lifting of sheets along their entire length, rather than just in the middle. In this manner, the clip lift acts similar to a suspension bridge, supporting the weight of the sheets while moving the tissue upward.

The carton with the clip lift of the present invention is easier and more convenient to manufacture than known sheet dispensers. One advantage is that the elastic member is easily connected to the flaps of the end walls of the carton or is easily inserted through the open end walls of the carton as the carton is being manufactured. One way to manufacture the present invention is to first place a flat piece of cardboard onto a conveyor. Then, a continuous roll of elastic is unwound onto the flat cardboard. Two spots of adhesive are placed on the cardboard to attach the elastic member to the cardboard where the end walls will be located. Then, a stamping operation is carried out onto the flat cardboard to stamp the outline of the carton. This stamping operation also cuts the elastic member for each carton. Then, the cardboard is folded over and adhered to form a box shape with the two end walls open, similar to the carton shown in FIG. 2. The carton may then be flattened to be shipped to an entity, such as Kimberly-Clark Corporation, which manufactures sheets. After such shipment, the carton is un-flattened to have the box shape again. Sheets are then inserted into the carton.

Another advantage of the invention is that the elastic member is positioned parallel to the direction of insertion of sheets into the carton. This results in less tearing of the sheets caused when sliding the sheets over the elastic member. If the support member is utilized, it is even less likely that sheets will tear when being inserted into the carton because the support member is positioned between the sheets and the elastic member.

It should be understood that a wide range of materials are available for the elastic member 42 and the support member 32. In the embodiment where the elastic member 42 is stretched upon insertion into the carton 10, while the elastic member 42 may be made of any number of elastic materials which may be stretched, the elastic member 42 is preferably a rubber band. More preferably, the elastic member 42 is comprised of two or more rubber bands.

The support member 32 may be made of any material which can support the weight of the sheets. Preferably, the support member 32 is a material such as paper or cardboard. Cardboard is a good material because it is low in cost and is recyclable.

With respect to the HAE material, while the elastic member 42 may be made of any number of elastic materials which may be stretched, the elastic member 42 is preferably a rubber band. More preferably, the elastic member 42 is comprised of two or more rubber bands. while heating the HAE member 42 is essential to activate the HAE material, heating may be detrimental to the sheets 50, depending on the composition of the sheets. For example, heating the sheets 50 may be detrimental to the performance of the sheets or it may cause discoloration of the sheets 50. Thus, in a preferred embodiment, the HAE member 42 is microwave susceptible. This means that the HAE member 42 is activated by subjecting it to microwave treatment. The use of microwaves to heat the HAE member 42 does not result to anything detrimental occurring to the sheets 50. Thus, the carton 10 and thus the HAE member 42 may be subjected to microwaves either in the sheet production plant or by the consumer in a microwave in his or her home or office.

A discussion of how an HAE material is produced or how an HAE material becomes microwave susceptible is outside the scope of this invention. However, reference is made to U.S. Pat. No. 4,816,094, issued to Pomplun et al., which describes a microwave susceptible HAE. In addition, a formulation of HAE which includes carbon black results in microwave susceptible HAE. In the alternative, the HAE may be treated or coated on one or more surfaces with a microwave susceptor material in order to become microwave susceptible.

Of course, it should be understood that a wide range of changes and modifications can be made to the embodiments described above. It is therefore intended that the foregoing description illustrates rather than limits this invention, and that it is the following claims, including all equivalents, which define this invention.

What is claimed is:

1. A sheet dispensing system including a clip lift member comprising:

a carton, including a top wall, a bottom wall, two end walls and two side walls, a stack of interfolded sheets inserted in said carton, said top wall having a removable section defining an opening, wherein said sheets may be dispensed through said opening, and a clip lift member positioned beneath said stack of interfolded sheets and above said bottom wall of said carton, said clip lift member comprising an elastic member, including a first end and a second end opposite said first end, said first end of said elastic member being connected to one end wall of said carton and said second end of said elastic member being connected to the opposite end wall of said carton, wherein said stack of interfolded sheets is inserted in said carton in the direction parallel to said elastic member, and wherein, as sheets are dispensed from said carton and the weight of said sheets on said elastic member diminishes, said elastic member contracts in length between its first and second ends connected to said end walls, thereby biasing said sheets in an upward direction toward said opening in said top wall.

2. The sheet dispensing system including a clip lift member of claim 1 further comprising a support member positioned between said sheets and said elastic member, said support member supporting said sheets 20 as said sheets are biased in an upward direction.

3. The sheet dispensing system including a clip lift member of claim 1 wherein said elastic member is a heat-activatable elastic material which recovers its elastic properties after being heated.

4. The sheet dispensing system of claim 3 wherein said elastic member is a plurality of heat-activatable elastic materials.

5. The sheet dispensing system including a clip lift member of claim 3 wherein said heat-activatable elastic material is heated by microwaves.

6. The sheet dispensing system of claim 1 wherein said elastic member is stretched when connected to said end walls of said carton.

7. The sheet dispensing system including a clip lift member of claim 6 wherein said elastic member is a rubber band.

8. The sheet dispensing system including a clip lift member of claim 7 wherein said elastic member is a plurality of rubber bands.

9. A sheet dispensing system including a clip lift member comprising:

a carton, including a top wall, a bottom wall, two end walls and two side walls, a stack of interfolded sheets inserted in said carton, said top wall having a removable section defining an opening, wherein said sheets may be dispensed through said opening, and a clip lift member comprising a support member and an elastic member, said support member positioned beneath said stack of interfolded sheets and above said bottom wall of said carton, said support member positioned on top of said elastic member, said elastic member including a first end and a second end opposite said first end, said first end of said elastic member being connected to one end wall of said carton and said second end of said elastic member being connected to the opposite end wall of said carton, wherein said stack of interfolded sheets is inserted in said carton in the direction parallel to said elastic member, and wherein, as sheets are dispensed from said carton and the weight of said sheets on said support member and said elastic member diminishes, said elastic member contracts in length between its first and second ends connected to said end walls, thereby biasing said support member in an upward direction toward said top wall of said carton to bias said sheets in an upward direction toward said opening in said top wall.

10. The sheet dispensing system including a clip lift member of claim 9 wherein said support member is a cardboard material.

11. The sheet dispensing system including a clip lift member of claim 9 wherein sheet dispensing system including a clip lift member of said elastic member is a heat-activatable elastic material which recovers its elastic properties after being heated.

12. The sheet dispensing system including a clip lift member of claim 11 wherein said elastic member is a plurality of heat-activatable elastic materials.

13. The sheet dispensing system including a clip lift member of claim 11 wherein said heat-activatable elastic material is heated by microwaves.

14. The sheet dispensing system of claim 9 wherein said elastic member is stretched when connected to said end walls of said carton.

15. The sheet dispensing system including a clip lift member of claim 14 wherein said elastic member is a rubber band.

16. The sheet dispensing system including a clip lift member of claim 15 wherein said elastic member is a plurality of rubber bands.

17. A method of manufacturing a sheet dispensing system including a clip lift member comprising the steps of:

providing a carton, said carton having a top wall, a bottom wall, two end walls and two side walls, said end walls being comprised of at least one flap, said top wall defining an opening through which sheets are dispensed;

inserting an elastic member into said carton through a first end wall, said elastic member having a first end and a second end opposite said first end;

connecting said first end of said elastic member to one flap of said first end wall;

connecting said second end of said elastic member to one flap of the second end wall which is opposite said first end wall;

inserting sheets into said carton on top of said elastic member in the direction parallel to said elastic member; and folding said flaps of said end walls to close said carton.

18. The method of manufacturing a sheet dispensing system including a clip lift member of claim 17 wherein said elastic member is a plurality of elastic members.

19. The method of manufacturing a sheet dispensing system including a clip lift member of claim 17 wherein said elastic member is a rubber band.

20. The method of manufacturing a sheet dispensing system including a clip lift member of 17 wherein said elastic member is a plurality of rubber bands.

21. The method of manufacturing a sheet dispensing system including a clip lift member of claim 17 wherein said end walls are comprised of four flaps.

22. The method of manufacturing a sheet dispensing system including a clip lift member of claim 17 wherein said elastic member is stretched when being connected to said end walls, and wherein said stretched elastic member contracts in length between its first and second ends as sheets are dispensed from said carton and the weight of said sheets on said elastic member diminishes, thereby biasing said sheets toward said sheet dispensing opening.

23. The method of manufacturing a sheet dispensing system including a clip lift member of claim 17 wherein said elastic member is a heat-activatable elastic material which recovers its elastic properties after being heated such that said stretched elastic member contracts in length between its first and second ends as sheets are dispensed from said carton and the weight of said sheets on said elastic member diminishes, thereby biasing said sheets toward said sheet dispensing opening.

24. The method of manufacturing a sheet dispensing system including a clip lift member of claim 22 or 23 further comprising a support member positioned between said sheets and said elastic member, said support member supporting said sheets.

25. The method of manufacturing a sheet dispensing system including a clip lift member of claim 24 wherein said elastic member is a plurality of heat-activatable elastic materials.

26. The method of manufacturing a sheet dispensing system including a clip lift member of claim 23 further comprising the step of heating said heat-activatable elastic material by microwaves.

* * * * *

UNITED STATES PATENT AND TRADEMARK OFFICE

CERTIFICATE OF CORRECTION

PATENT NO. : 5,992,683
DATED : November 30, 1999
INVENTOR(S) : Wayne C. Sigl

It is certified that error appears in the above-identified patent and that said Letters Patent is hereby corrected as shown below:

Claims

Please renumber claim 25 as claim 26 and renumber claim 26 as claim 25.
In renumbered claim 26, delete "claim 24" and substitute -- claim 25 -- in its place.

Signed and Sealed this

Thirty-first Day of July, 2001

*Attest:*

Nicholas P. Godici

*Attesting Officer*

NICHOLAS P. GODICI
*Acting Director of the United States Patent and Trademark Office*